United States Patent [19]

Smith, Jr.

[11] 4,440,393

[45] Apr. 3, 1984

[54] TENNIS NET SUPPORT POST

[76] Inventor: Allan J. Smith, Jr., 1621 Old Springhouse La., Dunwoody, Ga. 30338

[21] Appl. No.: 305,476

[22] Filed: Sep. 25, 1981

Related U.S. Application Data

[63] Continuation-in-part of Ser. No. 56,322, Jul. 15, 1979, Pat. No. 4,291,875.

[51] Int. Cl.[3] ..... A63B 71/02

[52] U.S. Cl. ..... 273/29 BB; 256/35

[58] Field of Search ..... 273/29 B, 29 BA, 29 BC, 273/29 BB, 411; 256/35, 37, 42, 50, 51, 30, 31, 44, 59, 65, 23, DIG. 5, DIG. 6, 32

[56] References Cited

U.S. PATENT DOCUMENTS

| | | | |
|---|---|---|---|
| 901,449 | 10/1908 | Husted | 256/51 |
| 1,632,231 | 6/1972 | Holtz | 256/23 |
| 1,939,841 | 12/1933 | Briggs | 273/29 BB |
| 4,236,698 | 12/1980 | Compte | 256/23 |

FOREIGN PATENT DOCUMENTS

| | | | |
|---|---|---|---|
| 224671 | 11/1924 | United Kingdom | 256/35 |

*Primary Examiner*—Richard C. Pinkham
*Assistant Examiner*—T. Brown
*Attorney, Agent, or Firm*—William H. Needle

[57] ABSTRACT

An improvement in a tennis singles stick for elevating to the prescribed height at the required distance outside the singles play area a net supported across a doubles court to convert the doubles court to regulation singles play. The first embodiment includes: a unitary stick having upper and lower channels vertically spaced within the same plane and which are interconnected by a rigid support member positioned out of that vertical plane and which engages the ground. The upper channel is dimensioned to receive the top cable and band and the lower channel is shaped to receive the bottommost horizontal strand of the net. The first embodiment maintains the band and netting in a common vertical plane. The second embodiment of the invention includes a unitary, elongation element with an upper end which is detailed to receive the top cable of the net and the band covering the same, the bottom end of the stick engaging the ground. The netting is maintained out of the vertical plane of the band.

2 Claims, 4 Drawing Figures

TENNIS NET SUPPORT POST

CROSS-REFERENCE TO RELATED APPLICATION

This is a continuation-in-part application to my Pat. No. 4,291,875 co-pending application, Ser. No. 056,322, filed July 10, 1979 for a "Split-Singles Stick for Tennis Courts."

BACKGROUND OF THE INVENTION

1. Field of the Invention

This invention relates to regulation tennis net supports and, more particularly, to an improved tennis singles stick.

2. Description of the Prior Art

The Official Rules of tennis, among other things, states that the tennis net, which spans the width of the court and divides the playing surface into two equal halves, must be 42 inches above the playing surface at a distance of 36 inches outside of the playing surface. Inasmuch as most tennis courts are constructed in the doubles configuration, the permanent posts for supporting the net are installed for doubles competition in accordance with the official height and distance regulations. However, singles competition on a doubles court requires the use of temporary net posts or single sticks in order to elevate the net to the required height at the required distance outside of the narrower playing surface used for singles tennis.

The prior art singles stick usually is a unitary wooden element which is 42 inches tall and has a V-shaped notch formed on the top of the stick. The width and depth dimensions of the prior art stick receive little attention. Installation of that stick requires lifting the net over the top of the stick and inserting the top cable of the net into the V-notch.

The use of that prior art stick invariably results in at least one violation of the Official Rules, namely, that the net is elevated above the regulation height. Further, the prior art singles sticks are easily moved from their position by the ball in flight or a competitor or one of the ball assistants inadvertently hitting the stick.

SUMMARY OF THE INVENTION

The above disadvantages are overcome by the present invention, the first embodiment of which comprises a unitary singles stick having upper and lower channels spaced within the same vertical plane and interconnected by means of a rigid support positioned out of that vertical plane. The upper channel has an open top to receive therein the top cable and band of the tennis net. The lower channel has an open bottom and is dimensioned to engage the lowermost horizontal strand of the net. The first embodiment maintains the net in the same vertical plane along its length.

The second embodiment is also of unitary construction and includes a support element which has opposed ends, the bottom end being flat to engage the ground. The top end has a passage therethrough which is detailed to receive therein the net cable and ribbon band of the net.

Specifically, the passage of the second embodiment includes an arcuate cavity formed through top end and a slot beneath the cavity, the top of the slot communicating with the bottom of the cavity. The diameter of the cavity is sufficient to allow the top cable and the band around it to rest therein and the slot is of sufficient width to receive the band beneath the cable. The second embodiment does not maintain the net in the same vertical plane along its length, but it does maintain the net at the correct height.

By means of the two embodiments of the present invention, the net height or distance from the top of the net cable to the ground is at the regulation height of 42 inches and the stick is not dislodged by the action of the ball or the players.

Therefore, it is the primary object of the present invention to provide an improved single tennis stick.

Another object of the present invention is to provide a singles tennis stick which is economical to manufacture and easy to operate.

DETAILED DESCRIPTION OF THE ILLUSTRATIVE EMBODIMENTS

A. First Embodiment

Figure 2:
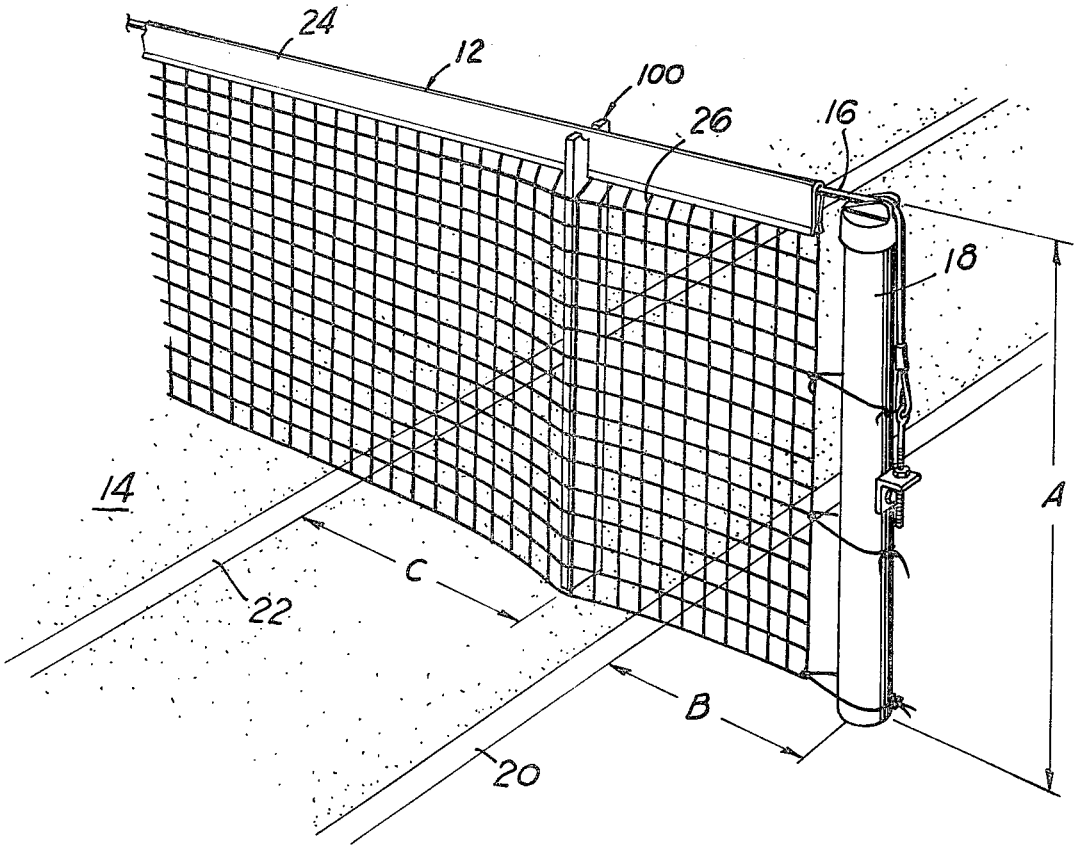
FIG. 2 is a partial perspective view of a doubles tennis court with the second embodiment of the present invention shown in its operative position.
Figure 1:
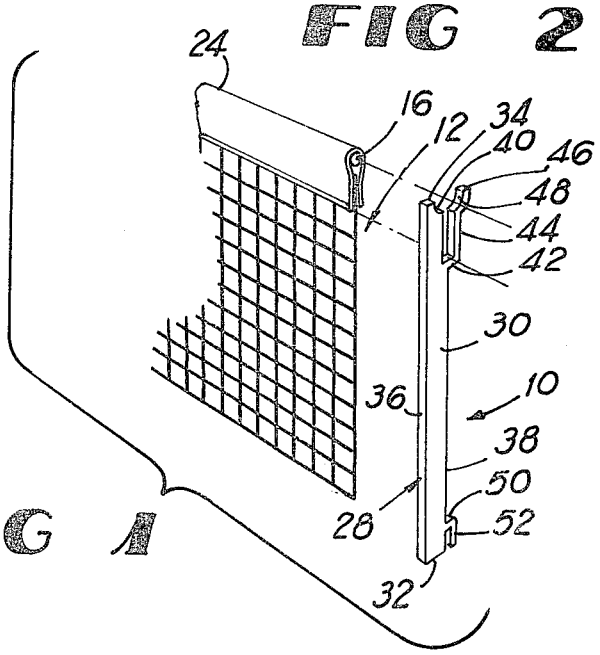
FIG. 1 is an exploded perspective of the first embodiment of the present invention.

Referring to FIGS. 1 and 2, the numeral 10 denotes generally the first embodiment of the present invention for use with a tennis net 12 which bisects a tennis court 14 that has a configuration for doubles tennis play. According to the *Code of Rules and Cases and Decisions*, which is referred to as the tennis Official Rules and which is the Official Code of the International Tennis Federation, the net 12 is supported from a cord or metal cable 16, the ends of which are attached to or pass over the tops of two posts (one of which is shown as numeral 18) which are 42 inches high, the center of each post 18 being 3 feet outside of the court 14 on each side thereof. Arrow B represents the regulation distance from the centerline of post 18 to the outside of the doubles line 20, or 3 feet.

In order to play a singles match on doubles court 14, the net 12 must still be elevated 42 inches high, 3 feet from the outside of the singles court, the boundary of which is shown by line 22. Therefore, arrow C which is the distance from the outside of line 22 to the centerline of stick 10 must be 3 feet and the stick 10 must elevate the net 12 to the regulation height a distance of arrow A.

The net 12 is of regulation construction, having a white band or tape 24 extending along the top of the net 12 and which covers the cable 16. The bottom edges of the band 24 are attached to the upper portion of the strands of interconnected vertical and horizontal netting 26. The width of band 24 may vary from not less than 2 inches to not more than 2½ inches.

The prior art singles stick comprised a unitary wooden element, 42 inches in length. A V-shaped notch was formed in the top of the stick to accommodate the cable and the band of the net. When the cable is inserted into the notch of the prior art stick, the band bunches up within the notch, thereby displacing the cable above the regulation 42 inches. Thus, the use of the prior art singles stick invariably causes a violation of one or more of the regulations regarding the net.

The stick 10 of the first embodiment includes a rigid support element 28 which is 42 inches in length and which has flat, opposed sides 30, a flat bottom 32, a flat top 34 and outer edges 36 and inner edge 38. An arcuate groover 40 is longitudinally formed at the juncture of top 34 and inner edge 38. Leg member 42 laterally extends from the inner edge 38 and terminates in upstanding wall member 44 that is parallel to inner edge 38. Wall number 44 terminates in an upper end 46 that is flush with top 34, the transition between wall member 44 and upper end 46 being made by arcuate groove 48 which is oppositely directed from groove 40.

Inner edge 38, leg member 42 and upstanding wall member 44 form an upper channel having a first passageway which is dimensioned to receive the top cable 16 and band 24 of the net 12. The grooves 40, 48 define a passageway for the cable 16 and band 24.

The radius of each groove 40, 48 is $\frac{3}{8}$ of an inch to define a cavity which is $\frac{3}{4}$ of an inch in diameter in order to receive therein the cable 16 which has a maximum diameter of $\frac{1}{8}$ of an inch. The width of the first passageway is $\frac{1}{8}$ of an inch.

An oppositely directed lower channel is formed on support element 28 adjacent bottom 32 by means of laterally extending element 50 which terminates in depending leg 52 that has a bottom surface which is flush with bottom 32. The lower channel has a passageway that receives therein a horizontal strand of net. The first and second passageways are disposed within the same vertical plane.

In the operation of the first embodiment 10, the band 24 is placed into the upper channel by inserting the wall member 44 in an opening of the net 12 which is located immediately beneath the lower edge of the band 24 and which is at the regulation 3 feet from the outside edge of the singles playing surface. The lower channel is then hooked onto the horizontal strand of net 12 which is next to the bottom edge of the net 12. In that manner, the inner edge 38 engages one side of net 12 and the net 12 is maintained in a vertical alignment along its length. If the support element 28 is jarred by a ball or a player, it will remain erect due to the engagement by the channel members of the band 24 and the horizontal strand of the netting 26, respectively.

B. Second Embodiment

Figure 3:
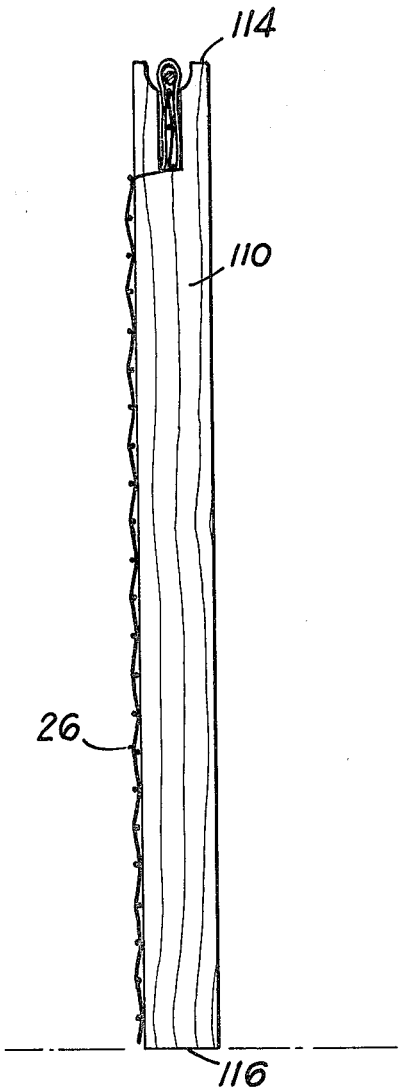
FIG. 3 is a side elevational view of the second embodiment.
Figure 4:
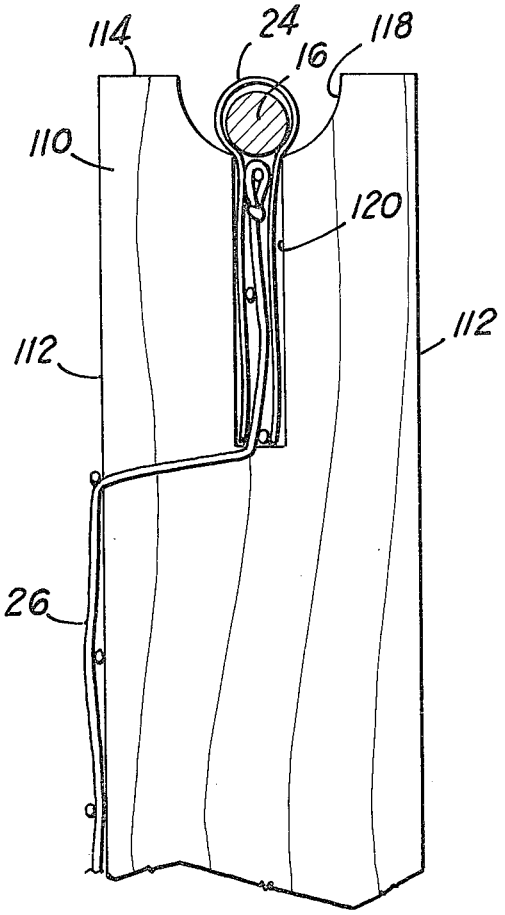
FIG. 4 is a side elevational view of a detail of the second embodiment.

The second embodiment of the invention is shown as numeral 100 in FIGS. 2–4. It is a unitary, substantially rectangular-shaped device having opposed, parallel vertical side walls 110, end walls 112 and horizontal top 114 and bottom 116. An arcuate cavity 118 laterally extends through top 114, the cavity 118 having a diameter of $\frac{3}{4}$ of an inch. A centrally-disposed slot 120 laterally extends through the sidewalls 110, the top of the slot 120 communicating with cavity 118. The distance from the bottom of the slot 120 to the top 114 is $2\frac{1}{2}$ inches in order to receive therein the band 24 and the cable 16. The top of the band 24 is flush with top 114 when the net 12 is placed in its operative position on singles stick 100.

The width of the stick 100 is such that it fits within the space created between two strands of vertical netting 26. In its operation, the band 24 and cable 16 are inserted into cavity 118 and slot 120 with the bottom 116 of stick 100 engaging the surface of the tennis court. As seen in FIGS. 3 and 4, the band 24 remains in a vertical position due to slot 120 but the remainder of the net 12 is moved out of the vertical plane of band 24. Thus, the second embodiment of the present invention maintains the net 12 at the required height but does not maintain the net 12 in a vertical plane.

What I claim is:

1. A device for supporting a tennis net for regulation singles tennis play on a doubles court, the net being of the type having a top cable, a band surrounding said cable and netting depending from the band, the netting composed of a network of horizontal and vertical strands, said support comprising: an elongated subsantially rigid, vertically extending member having an upper channel having an open top and a closed bottom, a lower channel having a closed top and an open bottom; said support member having a top and a flat bottom which engages the ground, said upper channel defining a first passageway dimensioned to receive therethrough said top cable and said band and said lower channel defining a second passageway dimensioned to receive a horizontal strand of said netting, said upper and lower channel being spaced so that said first and second passageways are within the same vertical plane and said rigid support member being disposed outside of said vertical plane, and wherein said upper channel includes a leg which horizontally extends from said support member adjacent the top of said support member, a wall upwardly extending from the end of said leg, said wall terminating in an arcuate-shaped which defines an inwardly directed groove, said top of said support member having a groove therein which is oppositely directed from said inwardly directed groove on said leg grooves defining an opening to receive therein said cable.

2. A device as claimed in claim 1 wherein said lower channel includes a portion which laterally extends from said support member adjacent its bottom and a leg which depends from the end of said portion, the bottom of said leg being flush with said bottom of said support member.

* * * * *